US005884576A

United States Patent [19]

Wajnikonis

[11] Patent Number: 5,884,576

[45] Date of Patent: Mar. 23, 1999

[54] MOORING ARRANGEMENT

[76] Inventor: Krzysztof J Wajnikonis, 16755 Ella Blvd. #134, Houston, Tex. 77090

[21] Appl. No.: 930,079

[22] PCT Filed: Apr. 11, 1996

[86] PCT No.: PCT/US96/04997

§ 371 Date: Nov. 14, 1997

§ 102(e) Date: Nov. 14, 1997

[87] PCT Pub. No.: WO96/33089

PCT Pub. Date: Oct. 24, 1996

[30] Foreign Application Priority Data

Apr. 18, 1995 [GB] United Kingdom ..... 9507826
Sep. 25, 1995 [GB] United Kingdom ..... 9519491

[51] Int. Cl.[6] ..... B63B 21/00

[52] U.S. Cl. ..... 114/230; 114/293

[58] Field of Search ..... 441/3–5; 114/230, 114/293

[56] References Cited

U.S. PATENT DOCUMENTS 3,111,926 11/1963 Shatto, Jr. ..... 114/230
3,434,442 3/1969 Manning ..... 114/230
4,067,282 1/1978 Guinn et al. ..... 114/230
4,889,065 12/1989 Van Den Haak ..... 114/293

*Primary Examiner*—Stephen Avila

[57] ABSTRACT

A new type of mooring arrangement is invented by providing conventional catenary spread mooring systems, taut leg spread mooring systems and tension leg platform mooring systems with additional branch lines (2-2; 3-3) and branch connections (2, 3). Branch lines and connections similar to (2-2) and (3-3) under this invention typically have ends connected to different legs (B-A) of mooring systems, as schematically depicted in FIG. 4. They can also have one end connected to leg (B-A) and the other end connected to other structural elements. Such connections can also join points of the same leg (B-A). The branch lines and connections can be used to modify technical characteristics of the invented mooring arrangement and to modify global and local loads in comparison with those in conventional systems. By novel, optimal arrangements of branch connections this invention allows to enhance the functionality of mooring systems and makes them more cost effective at increased water depths. This invention makes it feasible to significantly reduce total foot prints of mooring systems and reduce total weight of mooring components used in those systems.

8 Claims, 2 Drawing Sheets

MOORING ARRANGEMENT

Figure 1:
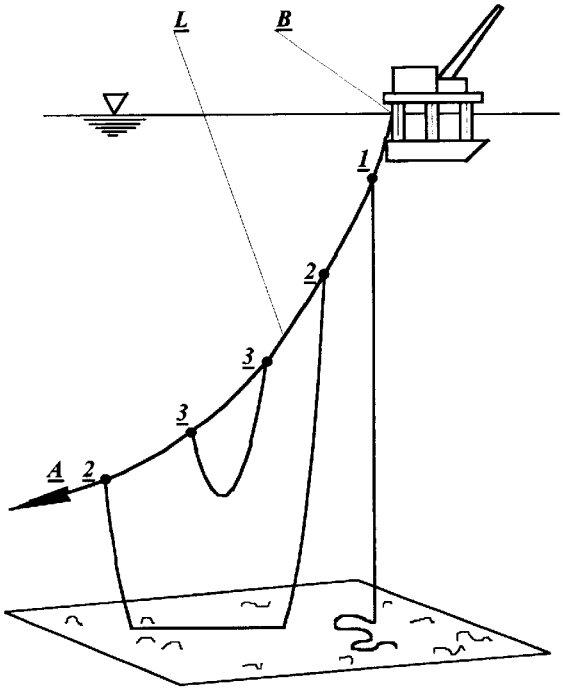

This is a continuation of co-pending application PCT/US96/04997 filed Apr. 11, 1996.

This invention presents a new type of arrangement of mooring lines to be used primarily but not exclusively in Offshore Engineering. The invention is particularly suitable for use in Catenary Spread Mooring (CSM) systems and/or Taut Leg Spread Mooring (TLSM) systems including auxiliary systems used to moor Tension Leg Platforms (TLP) and any systems combining features of the above mentioned types of systems but it can also be used in any configurations distinct from the above specified.

The said new Mooring Arrangement can be used for anchoring or mooring any structure which can be floating at or away from a water surface or can be wholly or partly supported on firm ground, which includes the Sea Bed. It also includes any naturally non-consolidated entity which has been converted to be sufficiently firm by any artificial means like piling, injection of concrete, etc. In particular following types of structures can be mentioned with an understanding that the below are examples only and the list of types of structures to which the invention applies includes also other types of structures which might be not mentioned: Vessels, Offshore Platforms, buoys, Floaters, Articulated Columns, Offshore Towers including Guyed Towers, Semi Submersible Rigs, Tension Leg Platforms, Spars, Turrets, Structures used for Single Point or Multiple Point Mooring, and others. In particular, any vessels or floaters used for drilling and/or mining and/or any testing and/or any research activity and/or production and/or storage and/or depositing and/or loading and unloading of any materials that include storage and production of any hydrocarbon materials and/or any other materials are included here under the description of any vessels or/and floaters. The vessels or floaters can be in particular wholly or partly floating and wholly or partly directly or indirectly supported on any fixed ground. Any turrets or turret like structures that are connected to any other structure or structures by any fixed, adjustable or moveable means are also included here. Turrets or similar structures that can be placed wholly or partly above water level or under water level are also included here under the description of structures. All these mentioned or those not specifically mentioned structures can be wholly or partly moored with the use of the hereby described new mooring arrangement. This novel mooring arrangement is intended for use in very deep, deep and medium deep water in particular, but it can be also used in shallow water Mooring Systems.

The storage or depositing is meant here as storage or depositing onboard or outboard in any tanks or holds or any other arrangements that can be wholly or partly suspended in water or wholly or partly placed on the seabed or wholly or partly placed under the bottom of the sea, lake, river or any other natural or artificial area of a similar description.

CSMs and TLSMs are typically used for mooring Offshore Structures. The classification of such Systems and their Characteristics are widely described in Technical Literature, for example by D'Souza, Dove and Kelly in OTC 7203, Houston, 1993. Static and Dynamic and Hydrodynamic Characteristics of particular arrangements of Mooring Lines in particular and those of Complete Mooring Systems that incorporate the Mooring Lines are very important for operation of Mooring Systems and of Moored Structures in varying conditions throughout the Design Lives of the Systems. These Design Lives can be in specific instances brief for example limited by a functional requirement to carry out a specific task or some specific tasks. In many other instances the Design Life can be related to semi permanent or permanent mooring and can span for many years or several decades. The Design Life specified for any Mooring Arrangement in general and for a Mooring Arrangement being subject of this invention in particular can be specified as one of the above described extremes or by any intermediate set of requirements failling between these extremes.

In particular OTC 7203 describes Catenary Lines which can have the same construction along their length or/and they can include various segments or legs built of various materials and/or they can have constant or/and varying weights per unit length. They can also have constant or/and varying mechanical properties, they can also incorporate clump masses, buoys or/and other heavy, buoyant or and/or neutrally buoyant rigid or flexible devices as well as any other devices not specifically mentioned here. Mooring lines like those used in CSMs are characterised in general by highly non-linear Static and Dynamic Characteristics. These depend on non-linear properties of catenary lines and on non-linear interactions between such lines and the sea bed. Particular Mooring Line Arrangements together with the above affect line Characteristics. It is particularly desirable for mooring lines to have compliant, "soft" Static Characteristics in order to reduce dynamic components in the line loading. On the other hand it is often necessary for a line to exhibit sufficiently hard Static Characteristics in order to enable a moored structure to displace less under environmental loads. Both the former and the latter are related not only to Statics, Dynamics and Hydrodynamics. Shapes of the Characteristics of Mooring Arrangements are also important from the points of view of Functional and Commercial requirements related to work of Moored Structures, performance of other systems and to constraints related to other systems like Rigid and/or Flexible Riser Systems. Work of other mooring systems like functional performance of Tension Leg Tethers versus auxiliary Catenary Lines are of crucial importance as well. A need to restrict horizontal deflection of Moored Structures by means of providing them with Mooring Arrangements having particular Characteristics can be also related to such Functional Limitations like proximity of other Structures and/or elements of their Systems, designated working areas, by presence of shoals, shores, Navigational Routes, Fairways, Navigational Ways or Navigational Obstructions and many others. Selection of a particular line characteristics depends on many environmental, installation, functional, commercial and material property related variables.

Many implementations of mooring systems have been suggested, most of them have in mind modifications of selected features of mooring systems. In particular Marshall's U.S. Pat. No. 5,054,415 has in mind functional benefits by providing a mooring system that incorporates a great deal of buoyancy devices which maintain the central part of this system near the water surface. In Marshall's arrangement this central part incorporates linking elements that connect legs of the mooring system and help to keep the central part near to the surface of the water. Marshall's functional arrangement makes his system autonomous from any mooring vessel, allows that one mooring system be used by many vessels that carry only limited mooring equipment (one vessel at any time) and allows time saving on mooring operations. All these result in operational benefits, the interconnection of lines is arranged only for functional reasons—making the system integral and independent from the presence or absence of a moored vessel. Accordingly, static and dynamic characteristics of Marshall's system would not be different from a conventional mooring system with all legs lead to a moored vessel, providing that these legs have similar lengths, similar weight distribution and similar buoyancy distribution as those used in Marshall's designs. Any reductions in lengths of mooring legs claimed by Marshall would not be greater than those in conventional systems using buoyant or partly buoyant legs.

In order to meet specific functional requirements of for example extreme weather conditions together with limitations imposed by the effectiveness of particular anchor arrangement, at a far end of the line, substantial lengths of mooring lines have to be used in order to become effective only in relatively rare extreme weather conditions. These long lengths of mooring lines can be reduced by replacing mid sections of the lines with clump mass-weights or buoys. Systems like that are described by OTC 7203. Such a hybrid CSM system line with a weight for instance would have similar Static Characteristics to that of an equivalent longer line having additional chain or rope segments of submerged weight equal to that of a clump mass. The compliance or stiffness terms due to the weight of such different line arrangements can be identical, while static components due to axial stiffness would in general differ, unless materials having modified axial stiffness are used. The lines could also have different Dynamic and Hydrodynamic Characteristics.

In conventional catenary Mooring Arrangements flexibility in the choice of Characteristics of a Mooring Arrangement is limited by an ensemble of features related in general to the type of used Arrangement or Arrangements, to the choice of particular piling or anchoring arrangement and by the Design Environmental Conditions. If the effects on line and system characteristics are considered, conventional Mooring Arrangements are in general characterised by using single line arrangements, like all those systems that are described above. Mooring lines in these systems connect anchoring devices like for example anchors or piles with f air leads on moored structures. Conventional Anchoring Arrangements have in general no additional branches or connections with other Mooring Line Arrangements and/or more connections with the Ground including the Sea Bed and/or with any Moored Structure or any of its parts or any Other Anchoring Arrangement as for example Tension Leg Anchors. Marshall's design can be also included in this category, because in his design the connecting lines serve only their purpose when the moored vessel is not present. According to Marshall, the interconnecting lines in his design become redundant while a vessel is moored to his system. It should be stated here that any length of a mooring arrangement which may temporarily lie on the seabed or be partially or wholly buried, whether these are temporary or permanent, is not regarded here as an additional connection to the Seabed. So described situations occur commonly in Conventional Mooring Arrangements and are regarded as fundamentally distinct from a Mooring Arrangement being a subject of this invention.

Reference is also being made to U.S. Pat. No. 3,111,926 by H. L. Shatto, Jr. Shatto invented an underwater apparatus that is anchored with lines provided with 'flexible weight means'. Shatto uses these 'flexible weights' in order to stabilize his underwater apparatus, that is subjected to action of wave forces due to orbital motions of water particles away from the water surface. The limitation of 'flexible weight means' to underwater use is noted here. Shatto's underwater apparatus differs in multiple ways from vessels or structures that pierce water surface that are mainly subject of this invention. The physical arrangement of Shatto's anchor lines and the physical principles used also differ significantly from those used in this invention. These multiple differences are explained below.

Amplitudes of orbital motions in waves and amplitudes of inertial forces acting on a vessel decrease underwater approximately exponentially with increasing depth. Drag forces on an object anchored underwater decrease even faster with increasing depth because they are approximately proportional to the square of motion amplitudes that decrease exponentially with depth, as already noted. Wave drift forces are of great importance for both static and dynamic characteristics of systems that anchor surface piercing vessels or structures, while they are hardly noticeable with regard to an underwater apparatus. Accordingly, the hydrodynamic forces that act on an anchored underwater object are considerably lower than those acting on objects anchored near or at the water surface—the vessel environment is different. In addition to this, vessels or structures anchored at or near the water surface are subjected to variable dynamic equilibrium between the vessel weight, inertia, buoyancy forces and mooring forces that is completely different than that of an underwater apparatus. There are even more differences in the physical environment of Shatto's underwater vessels and that of vessels and objects mainly considered in this invention when one takes into account breaking wave forces, wave slamming and slapping, a wide range of phenomena associated with entrapped air in the splash zone, etc. that are irrelevant in underwater environment. All these additionally contribute to the different environments of surface vessels and those of underwater vessels.

Therefore, in Shatto's design anchor lines deal with relatively small variations of forces. U.S. Pat. No. 3,111,926 uses weight alone to enhance the performance of each anchor line, that acts in isolation from all other anchor lines. The mooring arrangement according to this invention is additionally different from that invented by Shatto, because this invention uses extensively tension forces in mooring branch lines in order to enhance and to a large extent in order to replace weight used in conventional moorings. In order to illustrate this difference reference is made to FIG. 2, FIG. 3 and to FIG. 4. Branch lines according to this invention that are depicted in these figures rely on their tensile strength, the key feature used in this invention that is absent in Shatto's design, for any kind of vessel, surface or underwater. It is noted that branch lines according to this invention, like those depicted in FIG. 2 through FIG. 4, can be positively or negatively or neutrally buoyant and in all these three cases the combinations of tensile strength and elasticity of said branch lines allow in this invention to enhance the mooring system performance. This invention allows to replace hundreds of meters and in deeper water miles of traditional anchor wire or chain with relatively short and light branch lines. Said here invented branch line induces at its connection point a considerable change of direction in the main mooring line due to the tension in the branch line. In conventional systems such changes in directions of mooring lines would be only possible abruptly by use of heavy lump weights or buoyant components. Similar gradual change of direction is achieved in conventional designs due to weight or buoyancy of long segments of main mooring lines. In order to achieve the same effect a great deal lighter branch connections are used in this invention.

In order to additionally illustrate the latter difference, one can note that replacing Shatto's 'flexible weights' with neutrally buoyant components would not make any sense at all in an underwater apparatus or in a similar anchor line extended in this specification for use with surface piercing vessels and structures—it would have made the 'flexible weights' redundant.

In conventional mooring systems and in Shatto's systems changes of principal directions of mooring lines are only induced in the vertical plane and only by weight or buoyancy. Said here invented branch line allows to design arbitrary changes of directions both in vertical and in horizontal planes due to the action of tension forces. Thus this invention offers more flexibility in design, flexibility that was not present in conventional designs. Said here invented branch lines can be designed to closely model the characteristics or a traditional of a Shatto type mooring system, if one extends Shatto like design for mooring surface vessels, that by the way U.S. Pat. No. 3,111,926 did not do.

Figure 2:
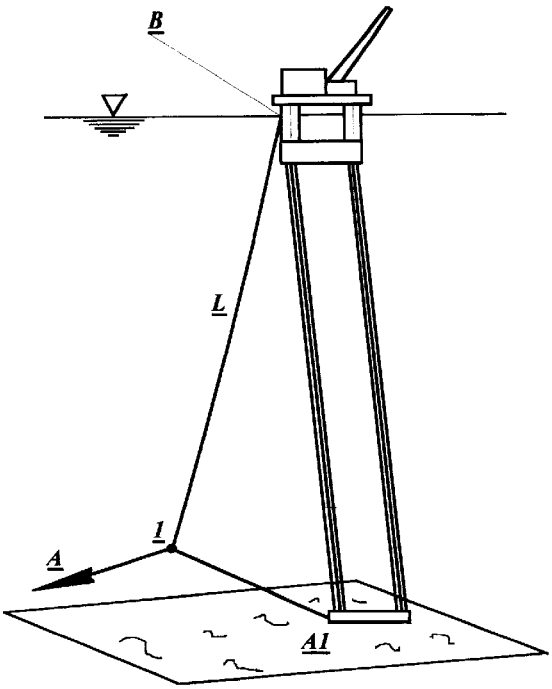
Figure 3:
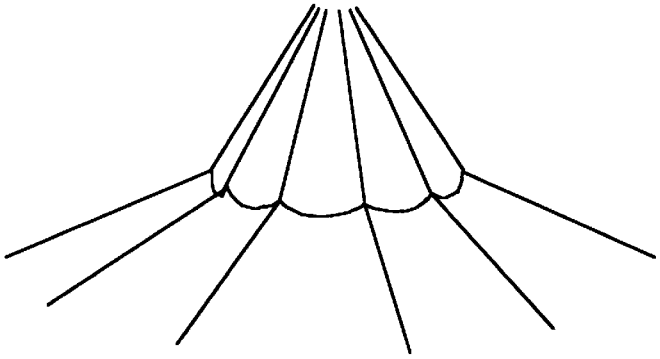
Figure 4:
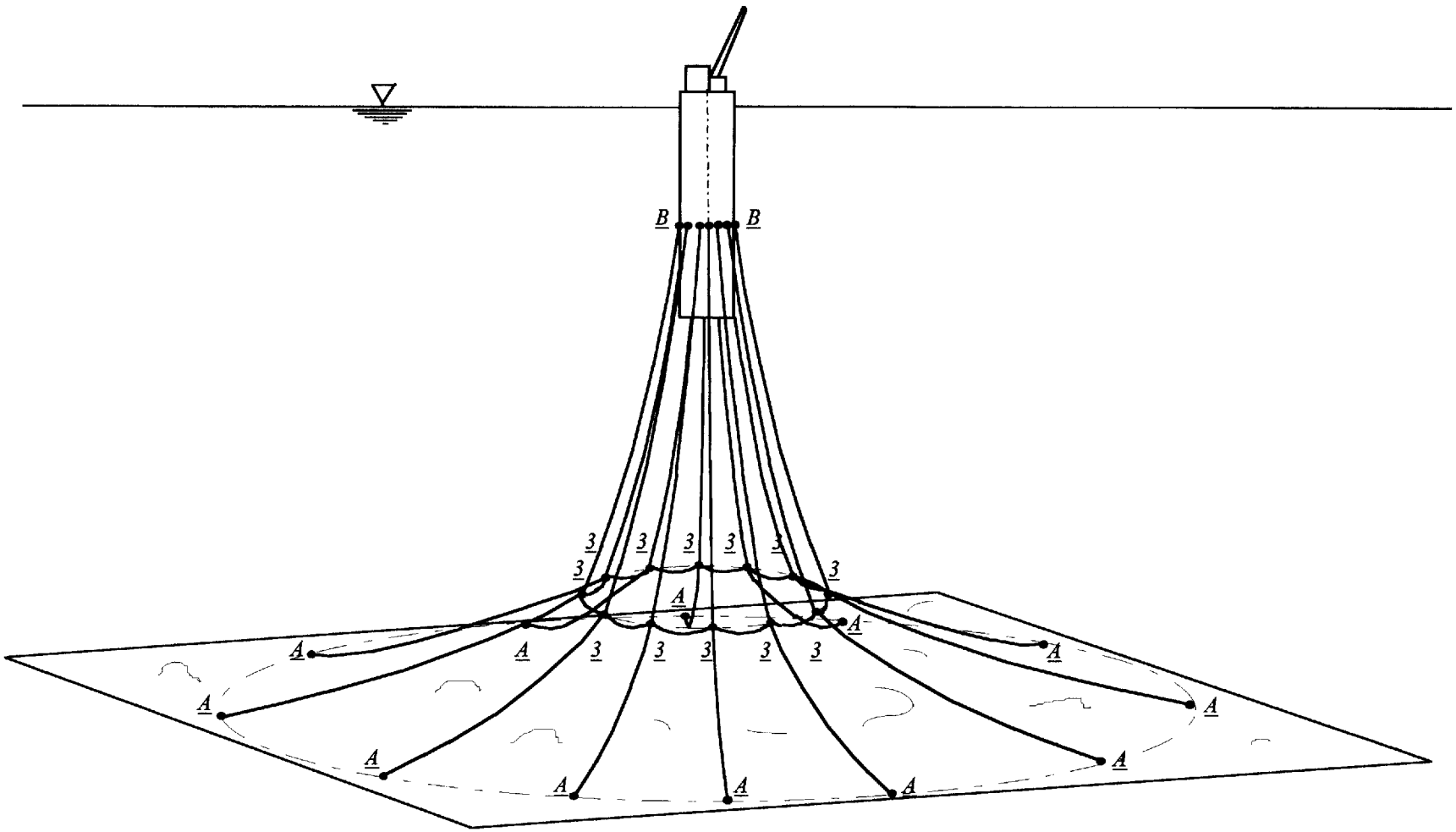

A yet another physical, obvious at a first glance difference between Shatto 'flexible weights' and branch mooring lines according to this invention is that in Shatto's design said 'flexible weight' is attached to a single anchoring line only. The here invented branch lines can typically have both their ends connected to other parts of the mooring systems. In FIG. 2 the other branch line end connects for example only to an anchored base. In FIG. 3 and FIG. 4 the other ends of branch connections join to other main mooring lines. In FIG. 1, branch line types 2-2 and 3-3 add line tension forces at two locations on the same main mooring line. Neither of these is used in Shatto's design of an underwater apparatus. The here outlined obvious physical differences between this and Shatto's design have whole ranges of technical implications that are described in other sections of this specification. Branch lines that connect mooring lines with other mooring lines like those depicted for example in FIG. 3 and branch lines that connect mooring structures, like the one depicted for example in FIG. 2 can be designed to add to mooring systems a great deal more flexibility than those of type 1 depicted in FIG. 1. Therefore, while comparing these variations of this invention, the former can be regarded as more important than the latter. Branch line connections like those shown for example on FIG. 4, FIG. 3 and FIG. 2 are regarded as depicting the types of main implementations of this invention. However, branch connections depicted in FIG. 1, type 1 show a useful, here invented extension of U.S. Pat. No. 3,111,926 to a different physical environment, to environment of higher and more complex loads and typically, but not exclusively, of much bigger vessels and structures. It is noted, that with regard to anchoring an underwater apparatus branch lines of type 1, FIG. 1 are not claimed in this invention.

U.S. Pat. No. 4,889,065 by van den Haak demonstrated a use of an anchor branch line during the installation of a traditional mooring system. Van den Haak's invention is used in order to quickly pretension drag anchors before they start work in a completed mooring system. Van den Haak's pretensioning lines have no role to play once the system installation is completed.

U.S. Pat. No. 4,067,282 demonstrates for example only the use of auxiliary lines of types that have been widely used for a long time for various handling operations and for marking components of mooring systems with buoys. These are of no consequence for basic characteristics of a mooring system.

There is also a known mooring arrangement having two or more legs which is known to limit the area of circulation of a single anchored vessel or structure with varying directions of predominant environmental forces. In such arrangements two or more anchoring lines can join between their anchors and a single line, for example through a swivel linking device. Such an arrangement is used mainly for the above mentioned reason and not in order to design flexibly new sets of Characteristics of particular Mooring Arrangements as it is the objective of this invention. Even though so described conventional arrangement would naturally have different Characteristics than an un-branched mooring arrangement, such variation of conventional arrangements is not claimed under this invention because any change in the Characteristics would be only a natural consequence of implementing different functional requirements. An additional distinction between conventional branched multi-leg systems and this invention is that the conventional systems are known to be used to moor relatively small craft where connecting the branches can be relatively easily handled, in particular manually handled. The latter highlights a yet another distinction between the arrangement being subject of this invention. This invention is designed for use in general, but not exclusively, for mooring permanently and semi permanently a great deal larger structures, even though the new principle can be used to moor also smaller structures or vessels whenever flexibly designed Characteristics are desirable.

OTC 7203 describes technological advances in the field of TLSM which were possible with the development and improved designs in two main fields. The developments in the first field are those of improved anchors which can reliably resist a vertical component force. The continuous developments in the second field are those of improved mechanical properties, durability and fatigue life of both exotic and more traditional artificial fibres, like for example varieties of aramid, polyester, carbon, glass, nylon and many others. In particular TLSM are now feasible for use in ever increasing depths. Conventional, already known Mooring Arrangements according to the principle of TLSM can rely for compliance in a greater extent on axial flexibility of mainly synthetic materials than CSMs that traditionally rely to a considerable extent on submerged weight.

Conventional systems combining any of the above features can be also designed.

The nature of this invention is to provide new Mooring Arrangements incorporating any numbers of Mooring Lines and Mooring Line Connections said Connections linking said Mooring Lines to any parts of Structures; said Structures including any parts of Floating Structures and any parts of Submerged Structures and any parts of Structures resting on the Sea Bed and Structures buried in the Sea Bed including any Anchors, which includes also any arrangement equivalent to piles and anchors and any shared Anchors and any parts of any combined anchoring arrangements and any parts of Structures suspended between other Structures; said parts of Structures including any of their integral parts and including any separate parts of any Structures; said Mooring Lines and said Connections being also classified as Structures and as said parts of Structures, whichever is more appropriate; said new Mooring Arrangements include but not necessarily require linking Mooring Lines with the same Mooring Lines and include but not necessarily require linking Mooring Lines with any number of other Mooring Lines and which include linking Mooring Lines with any number of lines having each any number of free ends and any number of points linked to other Structures and which also includes linking any number of Mooring Lines with any Number of Structures including any separate parts of said Structures and which also includes but not necessarily requires providing linking arrangements between Mooring Lines and other Lines and any Structures and any Branch Lines; whereas any of said Mooring Lines and any of said Branch Lines and said Connections incorporate an arbitrary number of legs and other segments, which in general would have differing technical features but in particular said legs and other segments can also have the same technical features; said Connections being in general adjustable but in particular could also be fixed, while any mixture of fixed and adjustable Connections is also included; said adjustable Connections said Mooring Arrangement having modified any set of Characteristics that includes Static and Dynamic and Hydrodynamic Characteristics of so combined Mooring Arrangement including those of any part of the said Mooring Arrangement; said Mooring Arrangement including also Structures and their parts that are linked in a fixed way and includes Structures and their parts that are linked in adjustable ways; said adjustable ways including any translational adjustments and any rotational adjustments, in particular incorporating any swivelling arrangement.

Examples of Mooring Line Arrangement according to this invention are illustrated on enclosed Figures. Mooring Lines and Branch Connecting Lines can be additionally fitted with clump weights or buoys and can have very complex structures. The corresponding design variations of this invention are not shown on the Figures for the sake of clarity only but they are still regarded as covered as novel according to this invention.

FIG. 1 depicts an example of a section of a mooring line. For simplicity only one main mooring line is depicted but it is understood that any number of similar or different implementations of this invention can be incorporated within any mooring system. Several possible arrangements of branch leg connections all connected to only one mooring line are illustrated. FIG. 1 shows an example of a Semi Submersible Rig with a mooring line Fair Lead 'B'. The line is anchored to the Sea Bed at its far end 'A'. The direction towards anchoring arrangement 'A' is indicated in the drawing. For the purpose of illustration of some possible implementations of this invention, three branch lines and their connections to the main line 'L' are depicted. At connection '1' a branch line with a free far end is connected to the main line. Such a branch line is used to 'ballast' the main line with an equivalent of a clump mass. In conventional systems clump masses have constant submerged weight, while the presented variation of the invented branch line connection results in submerged 'clump' weight with designed variation of submerged weight as a function of the tension in the main line. By suitably selecting the location of Connection 1 on the main line and/or by designing suitably the weight distribution along the Branch Line wide ranges of Line Characteristics can be designed.

Example Branch Lines according to this invention which are connected to the same Main Line by Connections 2 and Connections 3 are also depicted in FIG. 1. The action of these variations of the invented arrangement is that the variation in the 'ballasting' action and its effect on the Line Characteristics can be designed differently from the above. The Branch Line Loop can have overall constant, equivalent 'clump' weight, whenever the tension in the Main Line is such that the Loop is not in contact with the Sea Bed. Such a situation refers to Loop '3-3' while Loop '2-2' would provide a varying 'ballasting' effect. It is worthwhile to mention that in addition to the above the provision of Branch Lines Type '2-2' and Type '3-3' decrease to some extent the horizontal component of the tension in legs '2-3', '3-3' and '3-2' of Main Line 'L'.

FIG. 2 depicts a variation of this invention with a single Mooring Line 'L' Arrangement. For simplicity only one main mooring line and only one branch line are depicted but it is understood that any number of similar or different implementations of this invention can be incorporated within any mooring system. Connection '1' and an additional line '1-A1' are provided whereas the said line connects '1' with a location on or near to the Tension Leg Anchor or any other type of an anchoring device that can be used with any type of moored structure, in particular, but not exclusively of a tension leg type. Line '1-A1' presented in FIG. 2 can also join Connection Point 1 with any connecting arrangement located between Tension Leg Tethers. Such arrangement would be particularly advantageous for some deep water TLPs, where tethers pulled outside would automatically transfer a higher proportion of horizontal forces acting on the TLP. Line 'A1-1' depicted in FIG. 2 is of a Taut Leg type but it is understood that any other type of any of the branch lines including said branch lines being in contact with the Sea Bed anywhere between locations '1' and 'A1' are also examples of implementations of this invention.

FIG. 3 depicts a variation of this invention showing several mooring lines on one side of a moored structure. The structure is not shown for simplicity, for the same sake labels on FIG. 3 were omitted—the drawing is self explanatory. Main mooring lines are interconnected with branch lines. The branch lines can be arranged to never be in contact with the Sea Bed, to be partly supported on the Sea Bed at some external loading configurations or to have a part permanently supported on the Sea Bed. These have already been described above in relation to FIG. 1. Provision of several sets of Branch Line Connections is possible within the framework of this invention. In particular these can be arranged as complete (closed) rings of branch lines linking some or all main mooring lines. The branch lines do not need to form closed rings. The branch lines do not have to be linked to the nearest mooring lines, as it is depicted for simplicity in FIG. 3. The mooring lines can be interconnected with any of the lines or branch lines and again any arbitrary number of connections is feasible. In particular, the ends of the branch lines can be connected or adjusted to different heights or locations on mooring lines. The latter can help in achieving highly asymmetrical Mooring Arrangement Characteristics. In particular such directional characteristics can be achieved by systematically linking ends of branch connections to higher locations on the main lines in some parts of the mooring system, while connecting the other ends of the said branch connections to lower locations of other main lines. This might be desirable in cases of asymmetry in the shape of the foot print of motions of a moored Structure or for example in cases of asymmetries in the directions and strengths of predominant environmental forces. For simplicity many possible variations of FIG. 3, as described above are not depicted, the above explanation is considered sufficient.

FIG. 4 depicts schematically a mooring system similar to that shown in FIG. 3. FIG. 4 illustrates this particular type of mooring arrangement according to this invention used as an example to anchor a spar type structure. Any other type of structure can be moored by the here invented mooring arrangement. Any particular design implementation of this invention can incorporate any number of specific design modifications that are described in this specification. FIG. 4, as well as FIG. 1, FIG. 2 and FIG. 3 are meant only to schematically show some of described connections and many design implementations of this invention are described in the text and need not be depicted in the Figures.

Special considerations should be given to possibilities of excitations of dynamic oscillations of the invented systems. Adequate structural and hydrodynamic damping should be provided and in cases of a capacity to occurrence of hydrodynamically excited or environmentally excited vibrations the system should be optimised using standard methods applied in engineering. The list of these methods is long. For example one can mention means like suitable subdivision of the system, varying technical parameters of similar elements, use of vortex suppressers, etc.

In particular, a natural way of subdividing any mooring system is by providing it with branch lines being suitably tensioned under load. These branch connections can be beneficially integrated into the design of said systems according to said invention in order to increase the natural frequencies of the system or any of its subdivision. This way of implementing said invented mooring arrangement in the design is particularly beneficial in reducing dynamic responses of said systems to second and higher order environmental excitations, in particular by waves.

The above mentioned variations of the Arrangement shown as an example in FIG. 3 have some additional advantages in relation to those already outlined. Firstly, interconnections of mooring lines with branch lines can be used to increase the overall reliability of the whole mooring system. Secondly, the load redistribution between the lines can be arranged to be more advantageous—the branch lines on the side loaded with tension pull the side lines closer to the direction of combined loading. Thirdly, it is possible to build in part of the system compliance into the compliance of the branch lines. This can be arranged by selecting any combination of the weight, buoyancy, design sag and axial stiffness of the branch lines. It is possible to design both very stiff and very compliant systems. Accordingly, using these variations of the invention can allow to considerably reduce the overall foot print of the mooring system in comparison with conventional CSMs and TLSMs. Axial Stiffness, Clump Weights, Buoys, Heavy legs and buoyant legs can all be used both to modify the Characteristics of the Mooring Arrangement and/or of the Mooring System as well as to decrease or modify loads on any elements of said Arrangement or said System or on any Structural Parts of other Structures to which any said loads can be transferred or on which any part of said loads can be imposed. Fourthly, some additional reliability can be built into a system used for example to moor Articulated Columns. A ring of branch lines can be designed to uphold the column in a close to upright position even after a failure of the universal joint connection, ball joint or any other compliant connection on the Sea Bed. This might be additionally important if the column is used for example to moor a tanker.

The capability of reducing and/or modifying the foot print of a Spread Mooring for a given depth or increasing the depth at which the system can be used is very important for deep water applications, including those for auxiliary mooring Tension Leg Platforms in deep water. Said capabilities can also be used in main mooring systems of any other type of structures. Tensioned branching connections provided with this invention can replace or complement heavy clump masses or large or bulky buoyant segments and additionally modify Characteristics of the Mooring arrangement. Use of this invention even only to replace clump masses or buoys would imply installation and economic advantages over conventional systems. These advantages involve the savings in the total weight of a system, replacement of elements which are difficult to handle with line legs, including elastic legs, decreasing the foot print of combined mooring arrangements and making the system more reliable and more compact.

In particular it is easy to show that the above described local redirecting of main mooring lines or legs by means of the hereby invented branch connections can be designed as having similar effect as considerable lengths of conventional steel cable or/and chain as clump weights of considerable submerged weight and/or as buoyant elements having considerable buoyancy. While concentrating, only for the sake of simplicity of the explanation, on such a replacement of conventional submerged weight (of line length, of clump weights, etc.) with submerged weight of branching connections, one can show in simple catenary type calculations that relative gain in submerged weight due to the use of this invention can be multi-fold. It is easy to achieve a submerged weight benefit of between factor of one and fifteen even in designs that have not been optimised in any way. Even higher relative benefits can be achieved by optimising the design, for example in order to minimise the total weight of the system, therefore the total amount of used steel, that is of course related to the total investment cost of the mooring system. In such a way one can achieve relative gains in the above specified range, but also higher gains between fifteen-fold and thirty-fold and even higher can be achieved within the frameworks of the invented design. While for simplicity limiting the example to the ratio of submerged weights: that of equivalent clump weight which has the same 'catenary' redirecting effect as a novel branch line to the submerged weight of this branch line, a similar demonstration of effectiveness could have been described with regard to replacing buoyant devices with branch connections. In both variations of the invented arrangement use is being made of tensile strength of the line material. This tensile strength supplement conventional use of the weight alone or the buoyancy alone or both effects combined. Here described advantages of this invention are implied by novel way of using tensile strength of material in addition to the conventional usage of weight and buoyancy of components of mooring systems. In these, like in many other applications, relying in the design process to an increased extent on tensile strength of materials, rather than on their weight and buoyancy, results in inherently more efficient designs.

The already described equivalence of conventional and novel systems allows to design novel systems that have similar technical characteristics to equivalent conventional systems, while saving weight and the amount of used materials. This alone would allow to considerably reduce the total foot print of the mooring system, but the list of benefits of the novel systems does not end here. Additional, secondary class of benefits of the new mooring arrangement occurs because of the way branching connections redistribute loads between the interconnected main mooring lines. These additional benefits allow even greater, additional reductions in the weight of a gravity type or wholly or partly buoyant system. This effect can be again simply described on an example of a 'heavy' mooring system, while it would also apply similarly to systems incorporating buoyant components or devices. When a horizontal or near to horizontal load is applied to the moored structure or vessel in any mooring system, tension in some mooring lines increases, and it decreases in lines on the opposite side of the structure, these lines become more slack. Due to the already described limitations in the capacity of anchors to tolerate vertical upward forces, considerable lengths of mooring lines and considerable weights of mooring lines are used in conventional systems in order to limit or completely remove these vertical upward forces on anchoring devices. In novel mooring arrangements according to this invention, branch connections can be designed in such a way, that a greater number of main lines 'are being lifted up' from the seabed.

In taut catenary types of systems this effect is similar—tensile loads are transferred to other legs of the system and there is a reduction of the maximum vertical loading of any anchor. In both these types of systems the maximum anchor uplift forces are reduced due to the 'redirecting' of these forces to other legs of the systems. These are associated with more even tension distribution between the mooring lines. Said mooring arrangements can be designed to make some lines on the 'conventionally slack' side to complement the whole system in reducing or completely removing the upwards vertical pull component on any anchoring device. Thus reductions or eliminations of the anchor uplifts can be achieved, whichever are required in any particular cases due to the used types of anchors or piles.

Whenever the design objective is not to reduce, but to keep this maximum vertical pull force component at the same value, even greater reduction of the weight or length of main mooring lines, or both, can be achieved. And this again can be automatically linked to considerable reductions in total foot prints of new systems in comparison with conventional one. Said novel design can also involve reducing the number of main mooring lines. Both these objectives can be also achieved together in said mooring arrangements. In particular, sections of 'main type of lines', that are not continued the whole length between the moored structure and the anchor, can be designed to supplement more typical main mooring lines. Such sections of lines would act essentially more like main lines than like branch lines and their ends can be connected to other main lines, to main lines and branch lines, to branch lines and/or for example one end can be connected to the moored vessel, while the other end can be connected to another line, that may act more like a branch line or more like a main line. In particular it is also possible to design section lines that have one end connected to an anchor, while the other end can be connected to another line.

In particular, the latter arrangement is recommended in some variations of this invention. For example, in the class of mooring arrangement that is depicted on FIG. 3 and FIG. 4, tension in the parts of the main lines between the anchors and the branch line connections would be greater than between the branch line connection and the structure. Accordingly, a higher number of 'main type of lines' can be provided in the mooring system on the side of the anchors, while a reduced number of lines can connect 'the lower part of the mooring system' with the moored structure.

While continuing with the line of examples of particular design implementations of the 'heavy' types of mooring systems and while keeping also buoyant systems in mind, it can be noted that optimisation of the novel system from the point of view of the submerged weight alone would result in the simplest case in a ring of branch line connections that is arranged relatively close to the seabed and that has relatively short main line connections to the anchoring devices. (Reference is made here to FIG. 3.) Such a system can be compared to two more conventional systems—one arranged above another. The lower system would be provided with relatively short connections to the anchors. Due to the redistribution of loads and weights, relatively short connections to the anchors would be sufficient in order to limit or remove vertical forces on the anchors. This lower part of the system provides a very stable mooring platform for the upper mooring system, where there is practically no limit, or very little limit on the upward components of the forces on the lower ends of the main leg lines. It can be also seen here that these upper mooring lines can be also arranged to be relatively short, thus the whole system can be designed in a very efficient way. More than two component systems in the above sense can be also used at various levels for mooring, if required. Other design considerations on the side of the mooring characteristics can be also included in the design process in addition to the above mentioned. These could include, but would not be limited to considerations related to the compliance of the systems, to their rigidity as well as considerations related to different aspects of the design of mooring systems—those related to specific functional needs, to installation needs, etc.

Design aspects related to functional and to installation needs deserve particular attention. These can imply different arrangements of the novel design that are optimised by taking into consideration different objectives than those already described. In particular, it can be overall more beneficial to arrange branching connections higher above the sea bed. Thus novel mooring systems need in practice be designed while bearing in mind complex modifications of the above described simple optimisation of the weight of the system. Installation considerations, immediate and future needs resulting from use of rigid and flexible pipelines, risers, umbilical lines, etc. should be taken into consideration in the design optimisation process. Design configurations of said novel mooring systems are affected by all these as well as by safety and good practice requirements. Particular design configurations of the invented mooring arrangement are affected by complex design considerations related to the moored structure, or structures, if more than one structure is moored by a shared novel mooring system. In particular riser and umbilical lines can be lead below or and above any branch connections. Particular design arrangement and locations of branch lines as well as selections of average slopes of mooring lines are affected by riser and pipe line systems. Because said novel mooring systems can be designed to be staticaly more stable than conventional mooring lines and also can be designed to be more reliable than conventional mooring lines, it might be worthwhile for the designer to consider leading risers and pipe lines closer to mooring lines than it would be acceptable in a conventional case.

Said mooring arrangement provides the designer with feasible options to considerably reduce maximum sway and surge amplitudes of a moored structure or vessel. Savings on the costs of supplementary dynamic positioning systems (DPS) can be made, because said invented mooring arrangements can be designed to replace DPS where it would have been desirable in a conventional system. Due to minimised maximum surge and sway amplitudes considerable saving can be additionally made on lengths of flexible risers and umbilicals. These savings can be made in any riser configuration, but even greater gains in lengths can be achieved, wherever such reductions in surge and sway amplitudes are achieved, that original configurations of risers can be replaced with different configurations. For example lazy wave risers can be replaced with simple catenary configurations, that use less flexible line. Savings achieved in this way can be considerable, in particular in installations that use many risers and in deep water installations.

It should be noted, that design solutions of medium and deep water mooring arrangements according to this invention offer yet additional advantages. Since said systems can be designed in a more cost efficient way than conventional systems, it becomes economically feasible to design said novel systems for deeper water than it would have been the case for conventional systems. Accordingly, medium and deep water oil and gas fields as well as many marginal fields in less deep water become economical due to the use of the invented mooring arrangements. Additional advantages are implied by these aspects of this invention. Because of the here described reductions in overall costs of said mooring arrangements in extreme situations, said mooring systems can be feasibly installed in deeper water, closer to the field, wells, pipeline end manifolds, etc. In such a way the overall costs of the development of said fields can be further reduced due to accompanying savings in the lengths of required rigid and flexible pipelines, lengths of necessary hydraulic and electrical lines, etc.

All the above mentioned direct and indirect economic advantages of said invented mooring arrangement should be considered in every particular design case. Only several classes of economic advantages are mentioned here, but other advantages that are implied by the use of this invention also exist and they should be included in the overall cost analysis of the field together with total investment, exploitation and installation costs of said invented mooring arrangement.

Because of the same class of needs, parts or wholes of said novel systems might need to be designed as more easily disconnectable than some other more permanent implementations of said mooring arrangement.

In addition to the above example of substituting conventional mooring systems with their more efficiently designed novel equivalents, any mooring system incorporating any implementation of the invented Mooring Arrangement can also be flexibly designed to have Technical Characteristics which are considerably modified in comparison with those of conventional mooring systems. In particular said mooring systems according to this invention can be designed to have more compliant or more rigid characteristics than those of conventional systems. Mooring systems according to this invention can be also designed to have more compliant characteristics in some directions and more rigid characteristics in other directions. These can be achieved to a considerable extent even by incorporating in a system permanently installed branch connections. In some cases or in some sets of weather conditions it might be, however, desirable to further enhance the above mentioned flexibility in improving the Characteristics of a whole system or/and of any of its component parts by carrying out geometric adjustments of effective lengths of any leg of the system. These can be carried out for example from a deck of any structure similarly to tension adjustments in conventional systems. Any adjustments can be also carried out by incorporating more complex adjusting means into the design and/or by changing the system geometry temporarily. Temporary or permanent modifications in the geometry of any invented system can be also carried for installation purposes in case of any subsea construction or installation works being carried out in the vicinity, etc.

I claim:

1. Mooring Arrangements incorporating any numbers of Mooring Lines and Mooring Line Connections said Connections linking said Mooring Lines to any parts of Structures; said Structures including any parts of Floating Structures and any parts of Submerged Structures and any parts of Structures resting on the Sea Bed and Structures buried in the Sea Bed including any Anchors, which includes also any arrangement equivalent to piles and anchors and any shared Anchors and any parts of any combined anchoring arrangements and any parts of Structures suspended between other Structures; said parts of Structures including any of their integral parts and including any separate parts of any Structures; said Mooring Lines and said Connections being also classified as Structures and as said parts of Structures, whichever is more appropriate; said new Mooring Arrangements include but not necessarily require linking Mooring Lines with the same Mooring Lines and include but not necessarily require linking Mooring Lines with any number of other Mooring Lines and which include linking Mooring Lines with any number of lines having each any number of free ends and any number of points linked to other Structures and which also includes linking any number of Mooring Lines with any Number of Structures including any separate parts of said Structures and which also includes but not necessarily requires providing linking arrangements between Mooring Lines and other Lines and any Structures and any Branch Lines, but which specifically excludes a use of weight means that are used to stabilise an underwater apparatus that have one end secured to a mooring line and have free ends; whereas any of said Mooring Lines and any of said Branch Lines and said Connections that are claimed under this invention incorporate an arbitrary number of legs and other segments, which in general would have differing technical features but in particular the said legs and other segments can also have the same technical features; said Connections being in general adjustable but in particular could also be fixed, while any mixture of fixed and adjustable Connections is also included; said Mooring Arrangement having modified any set of Characteristics that includes Static and Dynamic and Hydrodynamic Characteristics of so combined Mooring Arrangement including those of any part of the said Mooring Arrangement; said Mooring Arrangement including also Structures and their parts that are linked in a fixed way and includes Structures and their parts that are linked in adjustable ways; said adjustable ways including any translational adjustments and any rotational adjustments in particular incorporating any swivelling arrangement.

2. Mooring Arrangement according to claim 1, whereas clump weights are attached to said Mooring Arrangement at any locations including the Mooring Lines and including Branch Connections and including Branch Lines.

3. Mooring Arrangement according to claim 1, whereas buoyant components are attached to said Mooring Arrangement at any locations including the Mooring Lines and including Branch Connections and including Branch Lines.

4. Mooring Arrangement according to claim 1 which uses axial stiffness of any of its elements in order to reduce Static Loads in any number of its elements or in any number of connected Structures.

5. Mooring Arrangement according to claim 1 which uses axial stiffness of any of its elements in order to reduce Dynamic Loads in any number of its elements or in any number of connected Structures.

6. Mooring System incorporating any Mooring Arrangement according to claim 1.

7. Complete field development systems and any parts of field development systems incorporating any plurality of vessels, structures, risers, umbilical lines, wells, pipelines that use said mooring arrangement according to claim 1.

8. Use of branch connections in mooring arrangement according to claim 1, that modify dynamic characteristics of mooring systems, including any parts of said mooring systems, in such ways, that the natural frequencies of said systems and said parts of said systems are modified in comparison with conventional arrangements.

* * * * *